US010621816B2

(12) United States Patent
Bacchi et al.

(10) Patent No.: US 10,621,816 B2
(45) Date of Patent: Apr. 14, 2020

(54) GAMING TABLES FOR ROULETTE AND SIMILAR GAMES

(71) Applicant: GAMETEC INTERNATIONAL LIMITED, High Wycombe, Buckinghamshire (GB)

(72) Inventors: Steven Bacchi, Middlesex (GB); Lorenzo Bacchi, Denham (GB)

(73) Assignee: GAMETEC INTERNATIONAL LIMITED, Buckinghamshire (GB)

( * ) Notice: Subject to any disclaimer, the term of this patent is extended or adjusted under 35 U.S.C. 154(b) by 0 days.

(21) Appl. No.: 16/043,253

(22) Filed: Jul. 24, 2018

(65) Prior Publication Data

US 2020/0035068 A1 Jan. 30, 2020

(51) Int. Cl.

| | |
|---|---|
| ***G07F 17/00*** | (2006.01) |
| ***G07F 19/00*** | (2006.01) |
| ***G07F 17/32*** | (2006.01) |
| ***A63F 5/00*** | (2006.01) |

(52) U.S. Cl.

CPC ..... *G07F 17/322* (2013.01); *A63F 5/00* (2013.01); *G07F 17/3288* (2013.01)

(58) Field of Classification Search

CPC ..... G07F 17/322

See application file for complete search history.

(56) References Cited

U.S. PATENT DOCUMENTS 5,597,116 A * 1/1997 Morris ..... A47G 29/1209 232/20
5,743,798 A * 4/1998 Adams ..... A63F 5/00 273/142 B
6,283,856 B1 * 9/2001 Mothwurf ..... G07F 17/32 273/138.2
6,733,388 B2 * 5/2004 Mothwurf ..... G07F 17/32 273/274
7,094,150 B2 * 8/2006 Ungaro ..... G07F 17/32 273/274

(Continued)

FOREIGN PATENT DOCUMENTS

| | | | | |
|---|---|---|---|---|
| EP | 0 424 355 A1 | | 4/1991 | |
| FR | 1 003 486 A | | 3/1952 | |
| GB | 2560098 A | * | 8/2018 | ..... A63F 5/00 |

OTHER PUBLICATIONS

British Search Report Corresponding to GB1800332.7 dated Jun. 22, 2018.

*Primary Examiner* — Milap Shah

(74) *Attorney, Agent, or Firm* — Davis & Bujold, P.L.L.C.; Michael J. Bujold

(57) ABSTRACT

A gaming table (1;20) for roulette and similar games has a wheel (2) and a betting area (3) delineated on the table-top (9) with a rectangular hollow shoulder (8) upstanding along a longitudinal side wall (4) of the table (1;20). The inner wall of the shoulder (8) has a slot-opening (12) that is closed by a top-hinged flap (13) that opens inwardly against a spring action under pressure of chips (C) drawn onto the flap (13) across the table-top (9) from the betting area (3). Chips (C) admitted through the opening (12) fall onto a moving belt (15) of a conveyor system (16) leading to a chipping machine (18) under the table (1) for collection and sorting. In a modification, the chips (C) fall down onto the belt (15) via an inwardly inclined chute (22) under the table (20).

14 Claims, 4 Drawing Sheets

(56) References Cited

U.S. PATENT DOCUMENTS

| | | | | |
|---|---|---|---|---|
| 7,934,980 | B2 * | 5/2011 | Blaha | B07C 5/342 453/26 |
| 7,992,720 | B2 * | 8/2011 | Blaha | B07C 5/04 209/580 |
| 8,979,630 | B2 * | 3/2015 | Witty | G07F 11/32 463/17 |
| 2003/0036426 | A1 * | 2/2003 | ungaro | G07F 17/32 463/27 |
| 2004/0072609 | A1 * | 4/2004 | Ungaro | G07F 17/32 463/17 |
| 2004/0149539 | A1 * | 8/2004 | De Raedt | G07D 3/14 194/302 |
| 2006/0063586 | A1 * | 3/2006 | Krenn | G07F 17/32 463/25 |
| 2006/0068878 | A1 * | 3/2006 | Krenn | G07F 17/32 463/17 |
| 2011/0031685 | A1 * | 2/2011 | Jude | A63F 7/0005 273/126 R |
| 2011/0105002 | A1 * | 5/2011 | Blaha | G07D 3/14 453/58 |
| 2012/0231866 | A1 * | 9/2012 | Witty | G07F 11/32 463/17 |

* cited by examiner

GAMING TABLES FOR ROULETTE AND SIMILAR GAMES

FIELD OF THE INVENTION

This invention relates to gaming tables for roulette and similar games, and is concerned with facilitating the collection of chips from such tables.

BACKGROUND OF THE INVENTION

In a conventional game of roulette at a casino, the croupier attending the table withdraws the chips of non-winning bets from the table following each spin of the roulette wheel. The croupier does this by gathering all such chips together by drawing them from the betting area and elsewhere, laterally of the table onto a longitudinal side-wall of the table. They are then drawn by the croupier against this wall and along it towards the head of the table-top where the roulette wheel is located, for discharge through an opening in the table adjacent the roulette wheel. The opening leads to a chip sorting machine, namely, a so-called "chipping machine" that collects and sorts the chips for re-use.

While the croupier is marshalling the non-winning chips from the betting area and elsewhere to the discharge opening, his/her attention to the disposition of chips remaining in the betting area is, or readily can be, diverted to an extent that enables interference with the remaining chips of the betting area to go unnoticed. In particular, the location of one or more of the remaining chips may be changed, even by a small amount, for fraudulent purposes to enhance the win attributable to them.

SUMMARY OF THE INVENTION

It is one of the objects of the present invention to provide a form of table for roulette and similar games, which enables the extent to which the croupier is required to marshal the chips on the table for collection and sorting, to be reduced, and more particularly thereby, to reduce the likelihood and possibility of diversion of the croupier's attention during that operation.

According to the present invention there is provided a gaming table for roulette or similar game, in which the table has a side-wall located laterally of a betting area defined on the table-top, and wherein there is an opening in the side-wall for receiving chips gathered from the betting area and elsewhere and drawn laterally of the table from the betting area for discharge through the opening.

The opening in the side-wall may be a slot-opening lengthwise of the side-wall. A flap may be provided to close the opening, and may be hinged to open to admit through the opening chips gathered from the betting area and elsewhere that have been drawn across the table-top onto the flap. In this respect, the flap may be resiliently biased to open inwardly under pressure of the chips drawn onto it. Alternatively, the slot or other opening may be closed by a shutter which is movable to admit chips through the opening automatically or otherwise.

The chips admitted through the opening may fall or otherwise load onto a conveyor mounted within the side-wall or beneath the table-top, for carrying the chips received through the opening into a chipping machine for collection and sorting for re-use. Alternatively, the chips admitted through the opening may pass directly to the chipping machine. In either case, the chipping machine may be mounted under the table.

BRIEF DESCRIPTION OF THE DRAWINGS

A gaming table for roulette and similar games, according to the present invention will now be described, by way of example, with reference to the accompanying drawings, in which.

DETAILED DESCRIPTION OF THE PREFERRED EMBODIMENTS

Figure 1:
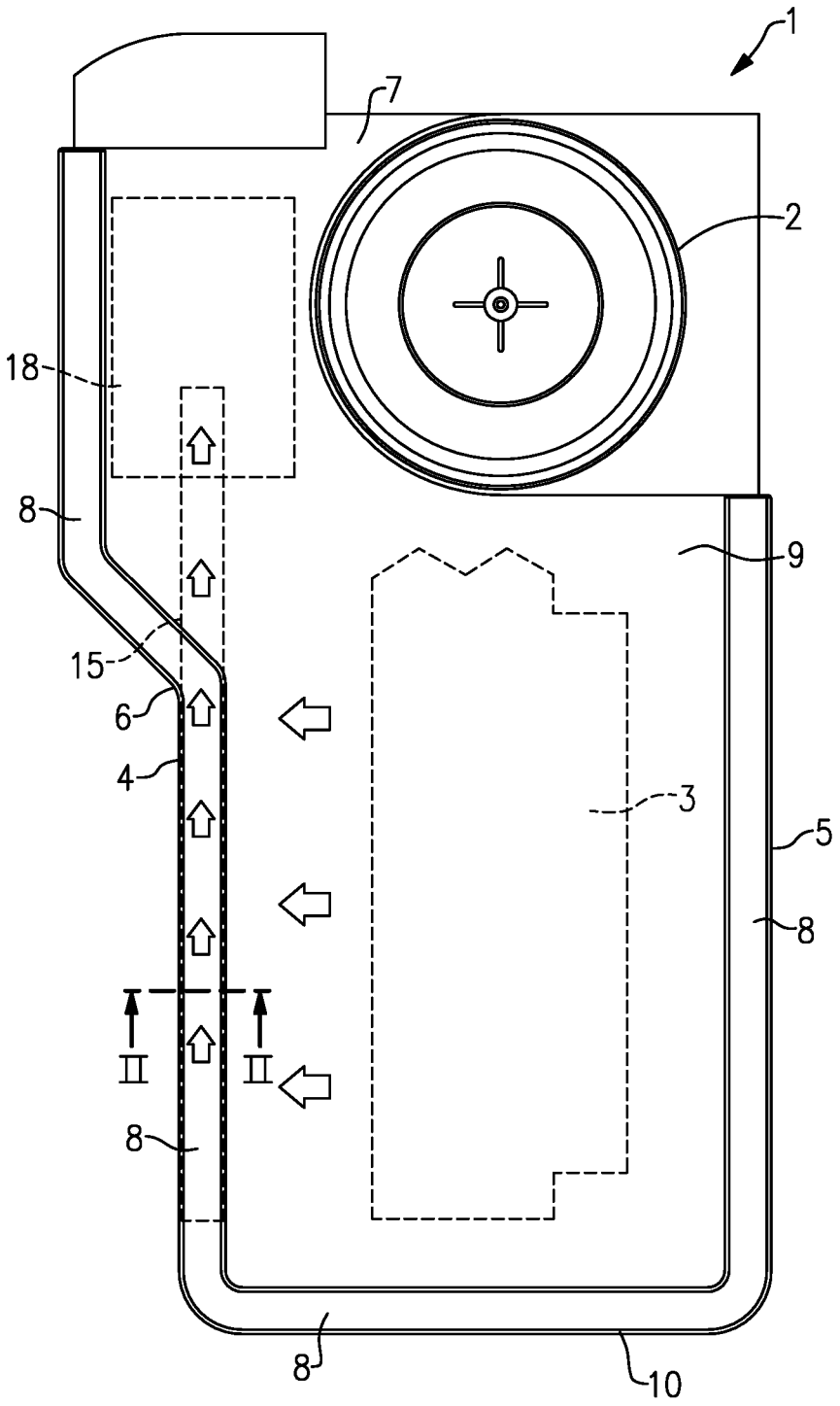
FIG. 1 is a plan view of the top of the table according to the present invention.

Referring to FIG. 1, the table 1 has a conventional layout for the game of roulette and similar games having a roulette wheel 2 and a betting area 3 (delineated by dotted line); conventional or other graphic features of the wheel 2 and the betting area 3 are omitted from the drawing. The table 1 is generally of an elongate rectangular configuration which on a side 4 of its two longitudinal sides 4 and 5 juts outwardly through an angled corner 6 to provide a head area 7 which is of an increased width to accommodate the roulette wheel 2.

Figure 2:
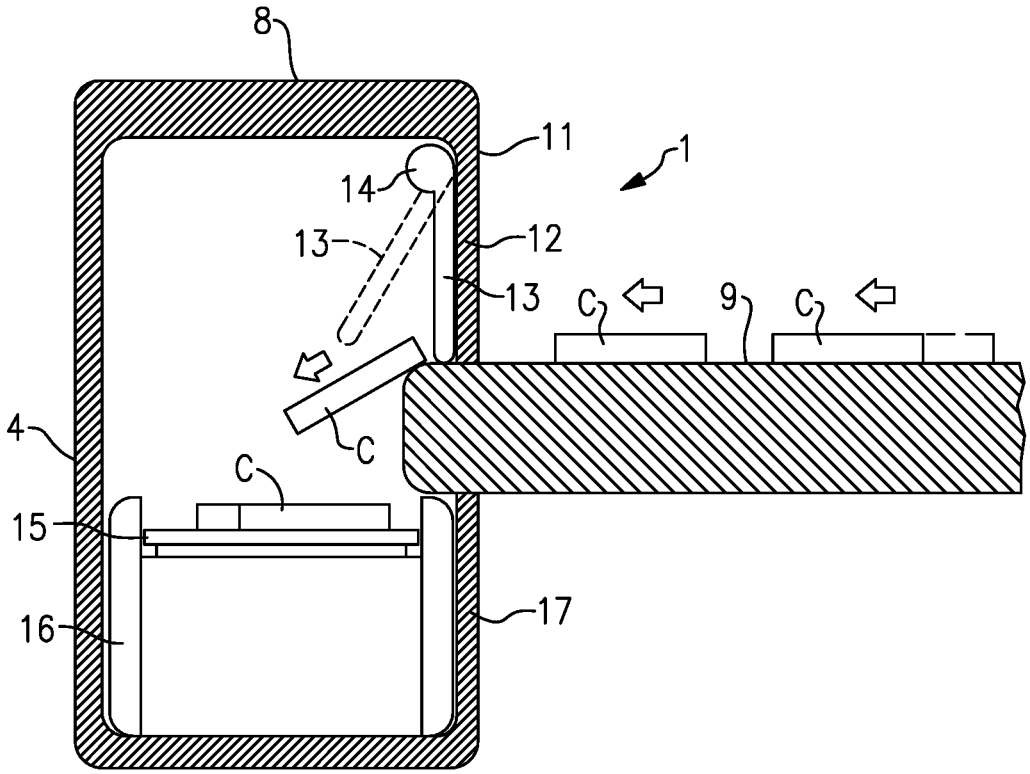
FIG. 2 is an enlarged sectional view taken on the line II-II of FIG. 1 illustrative of operation of the table of FIG. 1 in conjunction with a conveyor for transporting chips gathered from the table-top to a chipping machine for sorting and collection for re-use.

A shoulder 8, which may be upholstered, is upstanding from the table-top 9. It extends peripherally of the table throughout the length of the side 4, across the foot 10 of the table 1 and along the side 5 to just below the wheel 2. The shoulder 8 is rectangular in cross-section, and at least throughout most of its length along the side 4 between the foot 10 and the corner 6 is hollow. As illustrated in FIG. 2, the inner wall 11 of this part of the shoulder 8 has a longitudinal slot-opening 12 that is closed by a top-hinged flap 13.

The hinge 14 of the flap 13 includes spring-loading (not shown) that causes the flap 13 to retain the opening 12 normally closed (shown in full-line) but to pivot inwardly (as indicated in dotted-line) under the pressure of chips C that are gathered and urged against it across the table-top 9, by the croupier. However, the spring-loading of the flap 13 is generally sufficient to hold the flap 13 closed against any chips C that accidently strike it when thrown by players onto the table-top 9 legitimately during the game.

When the croupier scoops the gathered chips C individually and together against the flap 13, they enter through the opening 12 to fall onto a moving belt 15 of a conveyor system 16 that is mounted in a downward extension 17 of the arm 8 below the table-top 9. The moving belt 15 conveys the fallen chips C through to a chipping machine 18 as indicated in FIG. 1. The machine 18 collects and sorts the chips C for re-use.

Figure 3:
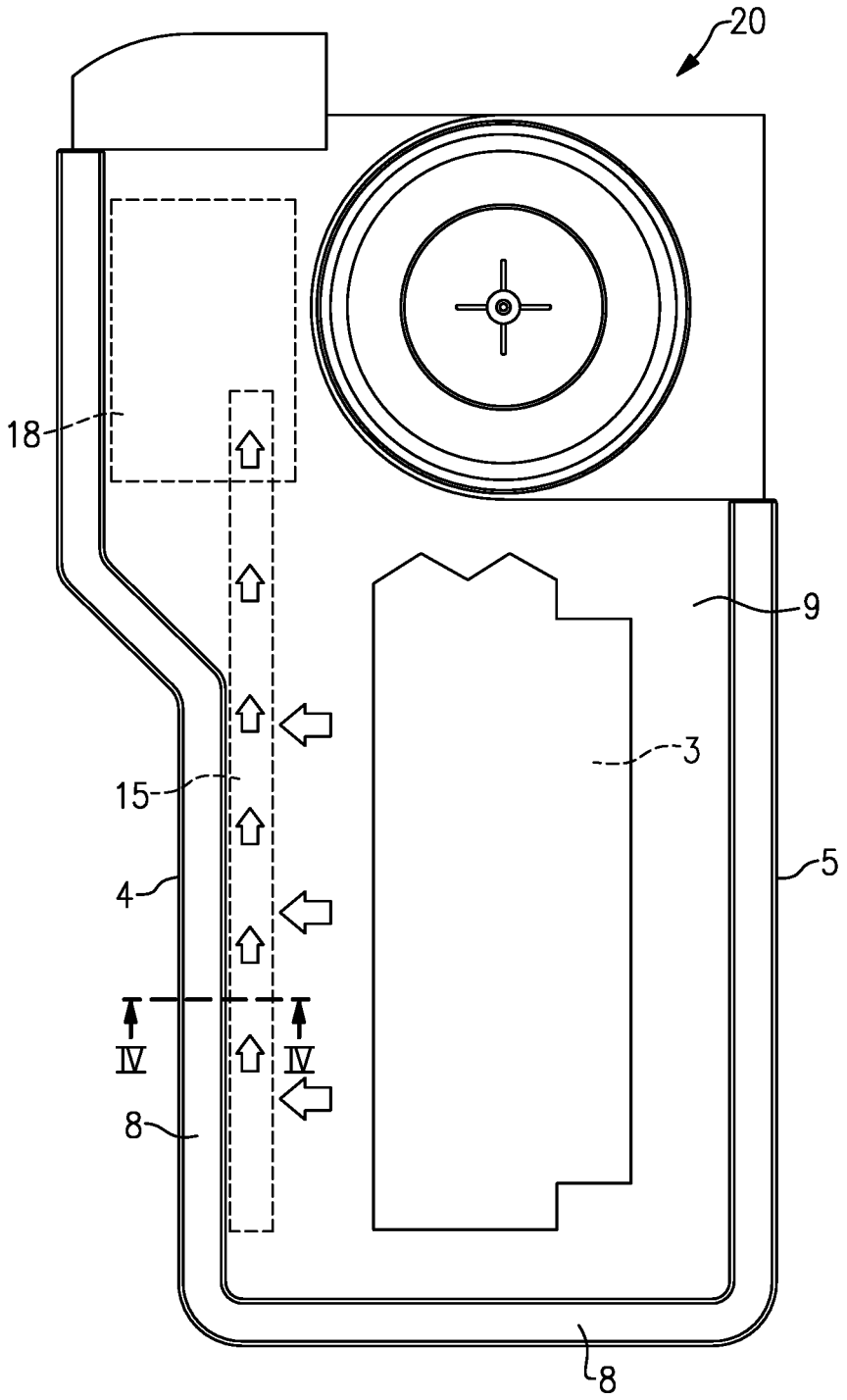
FIGS. 3 and 4 are, respectively, a plan and an enlarged sectional view corresponding to FIGS. 1 and 2 (the section of FIG. 4 being taken on the line IV-IV of FIG. 3) illustrative of a modification of the table of FIGS. 1 and 2 that may be adopted in order to provide more readily for mounting a conveyor and a chipping machine under the table.
Figure 4:
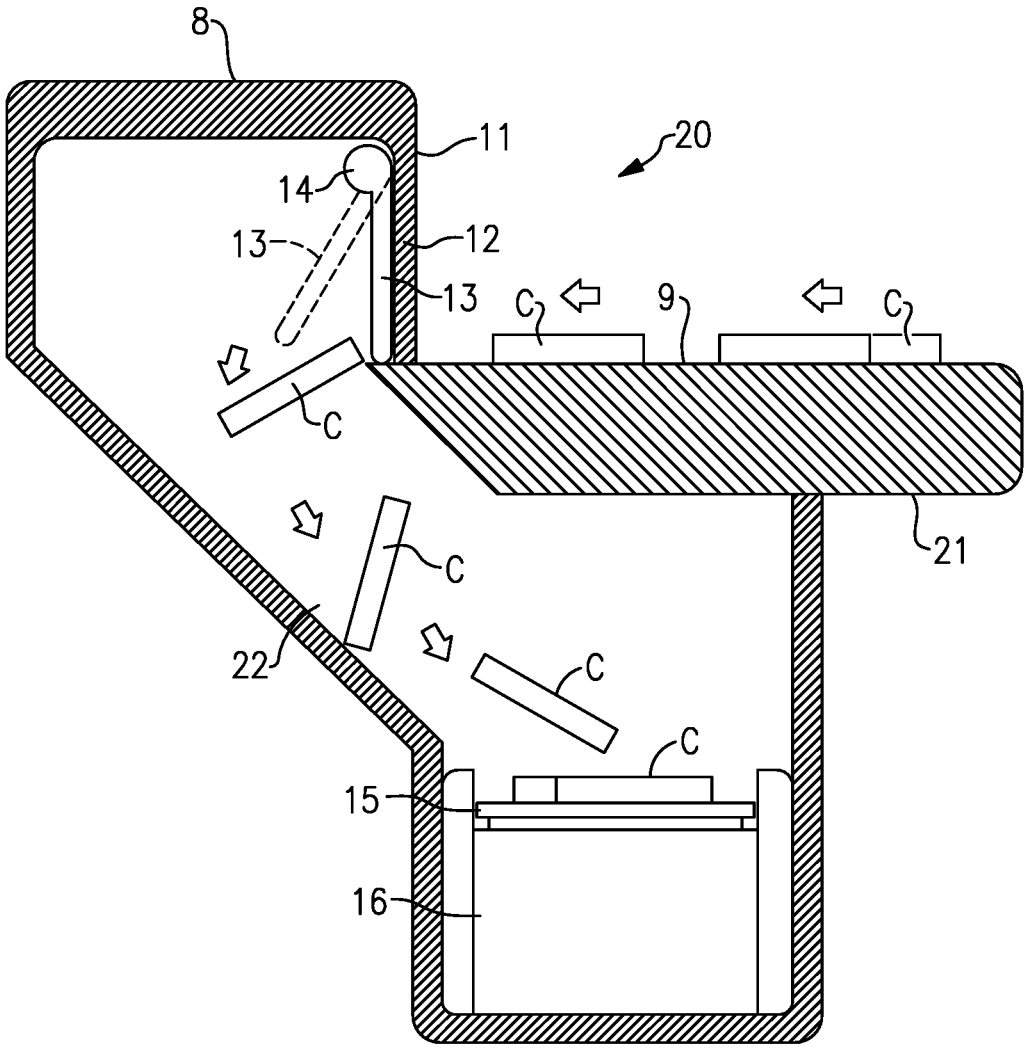

The need for a downward extension 17 of the shoulder 8 to accommodate the conveyor system 16 can be avoided by adoption of the modification of the table 1 illustrated by FIGS. 3 and 4.

Referring to FIGS. 3 and 4, the table 20 illustrated is a modified form of the table 1 in which the conveyor system 16 and chipping machine 18 are mounted on the underside 21 of the table 20 inwardly of the side 4. In this case, the chips C that enter through the opening 12 from the table-top 9, fall down a chute 22 that is inclined downwardly and inwardly under the table 20 onto the moving belt 15 of the conveyor system 16. The moving belt 15 conveys the fallen chips C through to the chipping machine 18 for collection and sorting.

The invention claimed is:

1. A gaming table, comprising:

a table-top to the table, the table-top having a head area;

a roulette wheel located within the head area of the table-top;

a betting area defined on the table-top spaced from the roulette wheel;

a side-wall to the table-top, the side-wall being located laterally of the betting area on the table-top; and means defining an opening in the side-wall for receiving and admitting therethrough chips gathered from the betting area and drawn laterally of the table-top from the betting area for discharge through the opening.

2. The gaming table according to claim 1 wherein the opening defined in the side-wall is a slot-opening.

3. The gaming table according to claim 1 including a flap for closing the opening.

4. The gaming table according to claim 3 wherein the flap is hinged to open for admitting through the opening chips gathered from the betting area and drawn across the table-top onto the flap.

5. The gaming table according to claim 4 wherein the flap is resiliently biased to open inwardly under pressure of the chips drawn onto it.

6. The gaming table according to claim 5 including a chipping machine for sorting chips admitted through the opening.

7. The gaming table according to claim 6 including a conveyor mounted beneath the table-top for transporting chips admitted through the opening to the chipping machine for sorting.

8. A gaming table for roulette in which the table has a table-top, a betting area defined on the table-top, and a side-wall to the table-top, wherein the side-wall includes means defining an opening in the side-wall located on the table-top laterally of the betting area, said means having selectively a closed condition in which the opening is closed and an open condition in which the opening is open to admit therethrough chips gathered from the betting area, the means defining the opening responding to pressure thereon of chips drawn laterally of the table-top from the betting area to adopt the open condition from the closed condition.

9. The gaming table according to claim 8 wherein the opening defined in the side-wall is a slot-opening.

10. The gaming table according to claim 9 wherein the means defining an opening includes a resiliently-biased flap.

11. The gaming table according to claim 9 wherein the means defining an opening includes a shutter.

12. The gaming table according to claim 8 including a chipping machine for sorting chips, and conveyor means for conveying chips admitted through the opening to the chipping machine for sorting.

13. The gaming table according to claim 12 wherein the chipping machine and the conveyor means are located below the table-top.

14. A gaming table for roulette reducing possible diversion of a croupier's attention during collection of chips following playing of a game, the gaming table comprising:

a table-top to the table, and the table-top having a head area;

a roulette wheel located within the head area of the table-top;

a betting area being defined on the table-top spaced from the roulette wheel;

a shoulder at least partially surrounding the betting area;

a side-wall of the shoulder being located laterally of the betting area; and a losing chip slot opening being defined in the side-wall of the gaming table laterally of the betting area and facing toward the betting area for receiving and admitting therethrough chips gathered from the betting area and drawn laterally of the table-top from the betting area for discharge through the losing chip slot opening, the losing chip slot opening lying in a plane extending normal to the table-top and at least a portion of the losing chip slot opening being located vertically above the table-top, and the losing chip slot opening being normally closed by a pivotable flap which is spring loaded so as to hold the pivotable flap closed against any chip that accidently strikes the pivotable flap during play of a game.

* * * * *